US005567147A

United States Patent [19]

Fenn et al.

[11] Patent Number: 5,567,147

[45] Date of Patent: Oct. 22, 1996

[54] BURNER FOR BURNING APPARATUS

[75] Inventors: Gordon W. Fenn, Brevard, N.C.; Yong S. Lee, Ansan, Rep. of Korea

[73] Assignee: Frontier, Inc., Ann Arbor, Mich.

[21] Appl. No.: 482,832

[22] Filed: Jun. 7, 1995

[51] Int. Cl.[6] ..... F23D 14/12

[52] U.S. Cl. ..... 431/328

[58] Field of Search ..... 431/328, 329

[56] References Cited

U.S. PATENT DOCUMENTS 4,752,213 6/1988 Grochowski ..... 431/328

*Primary Examiner*—Carroll B. Dority
*Attorney, Agent, or Firm*—George L. Boller

[57] ABSTRACT

A burner for a burning apparatus is disclosed including: a mixing liner support formed with an intake hole; a mixing liner for mixing supplied gas and first air; a matrix inserted into the inner upper portion of the mixing liner and having numerous flame holes in a gauze form; a mixing plate installed above the intake hole of the mixing liner support and spaced apart upward from the mixing liner support; a nozzle plate having a plurality of injection hole disposed at predetermined intervals on the same circumference; a gas chamber formed with a gas intake in the lower portion; and a gas valve for opening/closing the gas intake of the gas chamber.

5 Claims, 5 Drawing Sheets

BURNER FOR BURNING APPARATUS

BACKGROUND OF THE INVENTION

The present invention relates to a burner for a burning apparatus, and more particularly, to a burner in which the combustion of gas is performed in a full-first-air combustion method In which the overall amount of air necessary in perfect combustion of gas is mixed with the gas as the first air, thereby increasing combustion efficiency, obtaining good combustion stability, and preventing harmful gas.

As shown in FIG. 1, a general gas burning apparatus (gas quick water heater) employs a direct heating method in which cold water supplied via a water supply pipe 1 is heated by flames of a burner 3 located under a heat exchanging tube 2 while passing through it, and the heated water is discharged through an outflow pipe 4.

In the conventional burner 3, a plurality of burner fins are formed in combination according to the capacity of the burner. Through a gas valve 7 having a knob 6, and a nozzle (not shown), gas is injected to the plurality of burner fins and burned via gas ejection holes formed on the individual burner fins. An ignition rod 5 is installed around the gas ejection holes.

In order to operate burner 3, knob 6 is used to open gas valve 7 so that gas is injected to the individual burner fins through the nozzle (not shown) and burned through the gas ejection holes formed on the individual burner fins.

Since, according to the method of directly heating the heat exchanging tube, the conventional burner is installed under the heat exchanging tube and gas is burned through the numerous gas ejection holes whose top is opened on the same plane on which a plurality of burner fins are combined, this causes imperfect combustion due to the fact that oxides from corrosion of the heat exchanging tube and products of the burned gas fall to the burner fins to stop up the gas ejection holes. In addition, a plurality of burner fins are combined to increase the capacity of the burner, unnecessarily swelling the size of the burner.

SUMMARY OF THE INVENTION

Therefore, it is an object of the present invention to provide a burner for a burning apparatus in which the perfect combustion of gas is performed in a full-first-air combustion method, thereby increasing combustion efficiency, obtaining good combustion stability, and minimizing the production of harmful gas.

To accomplish the object of the present invention, there is provided a burner for a burning apparatus comprising: a mixing liner support formed with an intake hole for receiving gas ejected from a nozzle and first air at the center; a mixing liner, for mixing supplied gas and first air, which is installed above the mixing liner support, and on either upper sidewall of which an ignition plug installation hole and flame Sensor installation hole are formed, respectively; a matrix inserted into the inner upper portion of the mixing liner and having numerous flame holes in a gauze form; a mixing plate installed above the intake hole of the mixing liner support and spaced apart upward from the mixing liner support with a plurality of spacers, and for radially dispersing gas and the first air; a nozzle plate installed under the mixing plate and spaced downward from the mixing plate with the spacers, and having a plurality of injection holes disposed at predetermined intervals on the same circumference; a gas chamber installed under the nozzle plate and formed with a gas intake in the lower portion; and a gas valve installed under the gas chamber and for opening/closing the gas intake of the gas chamber.

BRIEF DESCRIPTION OF THE ATTACHED DRAWINGS

DETAILED DESCRIPTION OF THE INVENTION

Hereinafter, preferred embodiments of the burner of the present invention will be described below in detail with reference to the attached drawings.

Figure 1:
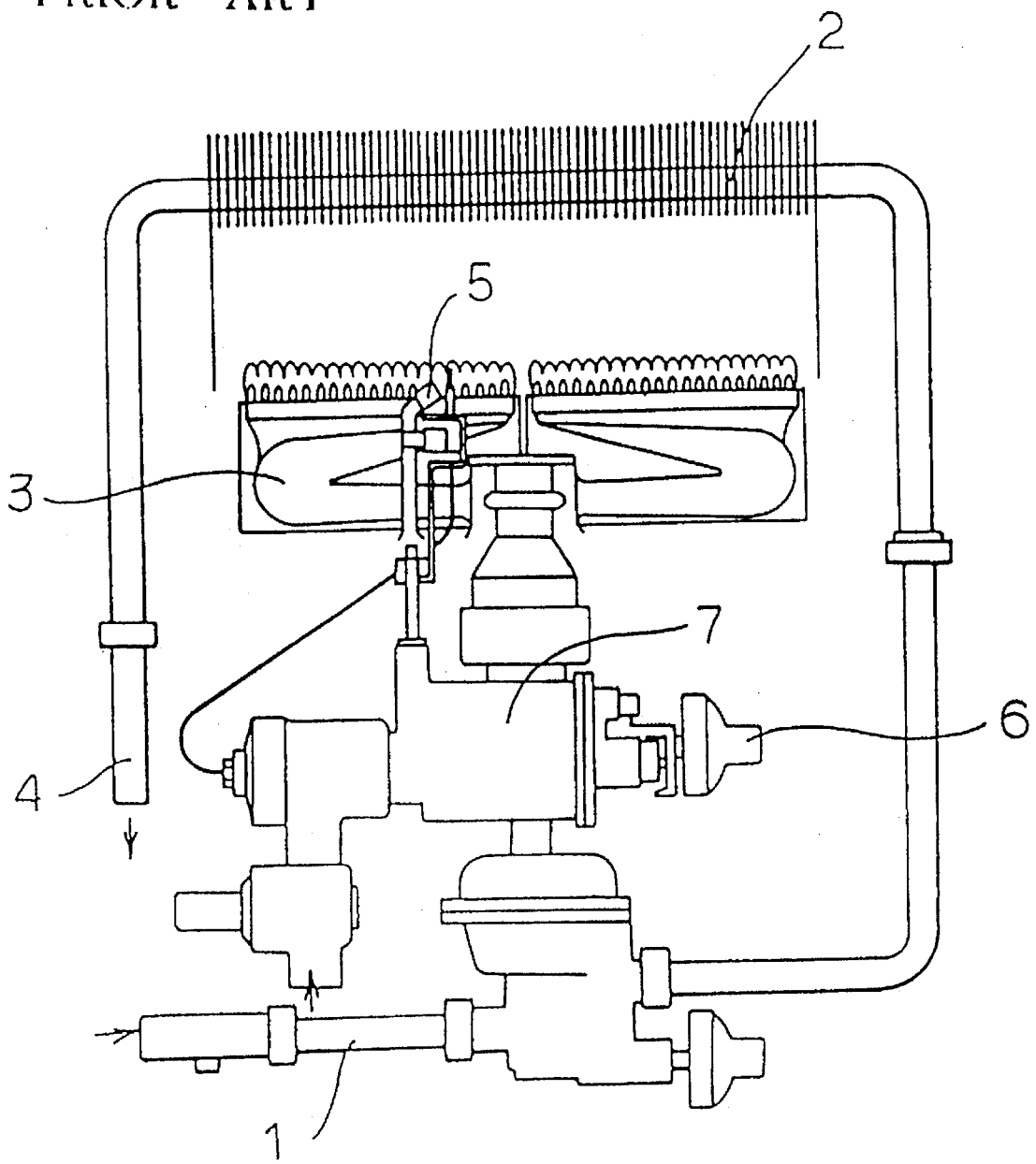
FIG.1 PRIOR ART
FIG. 1 is a schematic configuration view of a conventional burner.
Figure 2:
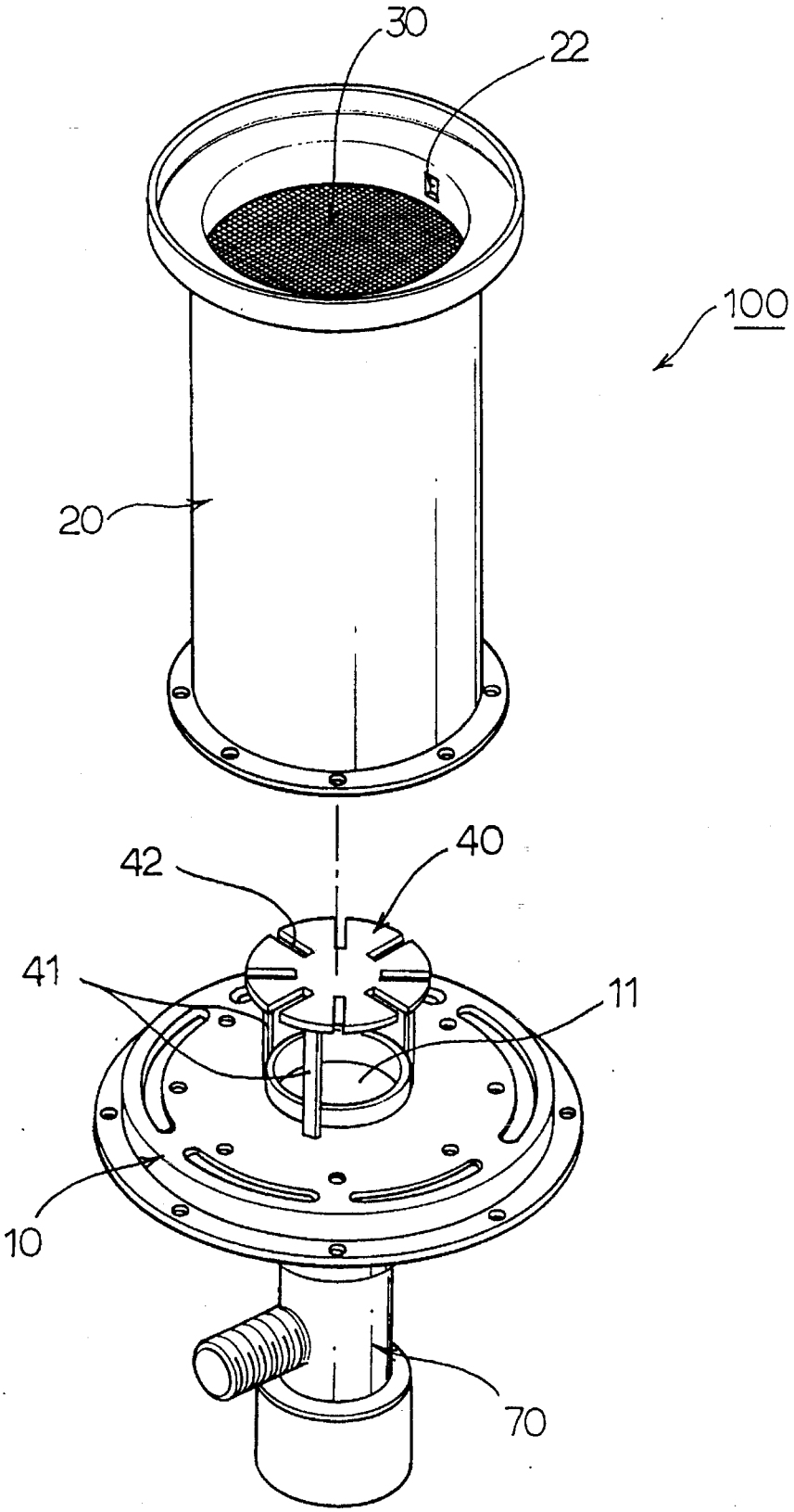
FIG. 2 is an exploded perspective view of one embodiment of a burner for a burning apparatus of the present invention.
Figures 3, 3A:
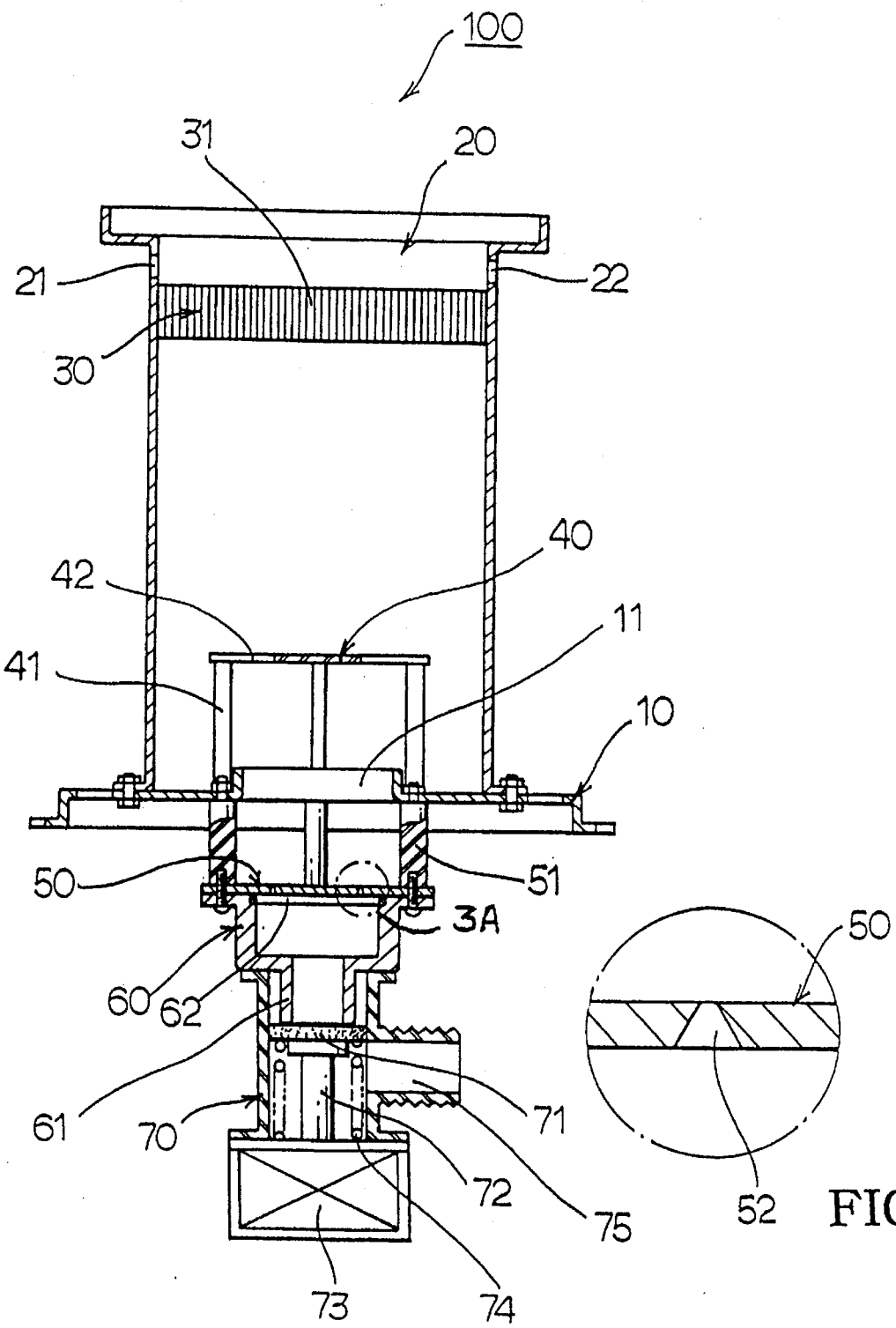
FIG. 3 is a front sectional view of the burner of the present invention.
FIG. 3A is an enlarged view in circle 3A of FIG. 3.

Referring to FIGS. 2, 3, and 3A a burner 100 of the present invention is used in a burning apparatus such as a water heater and boiler for the purpose of burning gas.

A mixing liner support 10 is installed at the middle height of a burning apparatus in a disk form. An intake hole 11 for receiving gas ejected from a nozzle and first air is formed by a predetermined height at the center of the support.

A cylindrical mixing liner 20 is installed above mixing liner support 10. On either/upper sidewall of mixing liner 20, an ignition plug installation bole 21 and flame sensor installation hole 22 are formed, respectively. Supplied gas and first air are mimed within mixing liner 20.

A matrix 30 with numerous flame holes 31 in a gauze form is installed in the inner upper portion of mixing liner 20. Through the numerous flame holes 31, mixed gas with the first air and supplied gas are ejected to be burned by the ignition of an ignition plug (not shown) above matrix 30.

Here, matrix 30 is installed lower than ignition plug installation hole 21 and flame sensor installation hole 22 of mixing liner 20.

Above intake hole 11 of mixing liner support 10 of mixing liner 20, a mixing plate 40 is installed while being spaced apart upward from mixing liner support 10 with a plurality of spacers 41 by a predetermined interval.

Mixing plate 40 is to radially disperse gas and the first air coming into intake hole 11 within mixing liner 20. In order to effectively disperse the gas and first air, a plurality of cut portions 42 are radially formed on mixing plate 40 by predetermined intervals.

Under intake hole 11 of mixing liner support 10, a nozzle plate 50 for injecting gas into intake hole 11 is installed while being spaced apart downward from mixing liner support 10 with a plurality of spacer 51 by a predetermined interval.

A plurality of injection holes 52 are disposed at predetermined intervals on the same circumference of nozzle plate 50. Injection holes 52 are narrower in the upper portion and wider in the lower portion so as to eject gas at a high pressure.

A gas chamber 60 with a gas intake 61 located thereunder is installed under nozzle plate 50. A closed ring 62 is provided between gas chamber 60 and nozzle plate 50.

A gas valve 70 for opening/closing gas intake 61 of gas chamber 60 is installed under gas chamber 60.

Gas valve 70 is constructed with a plunger 72 for opening/closing gas intake 61, a solenoid 73 for linearly moving plunger 72, a spring 74 for applying a upward force to plunger 72, and a gas supply hole 75 for receiving gas.

The amount of gas supplied can be controlled by controlling the on/off time of solenoid 73 by pulse control.

Figure 4:
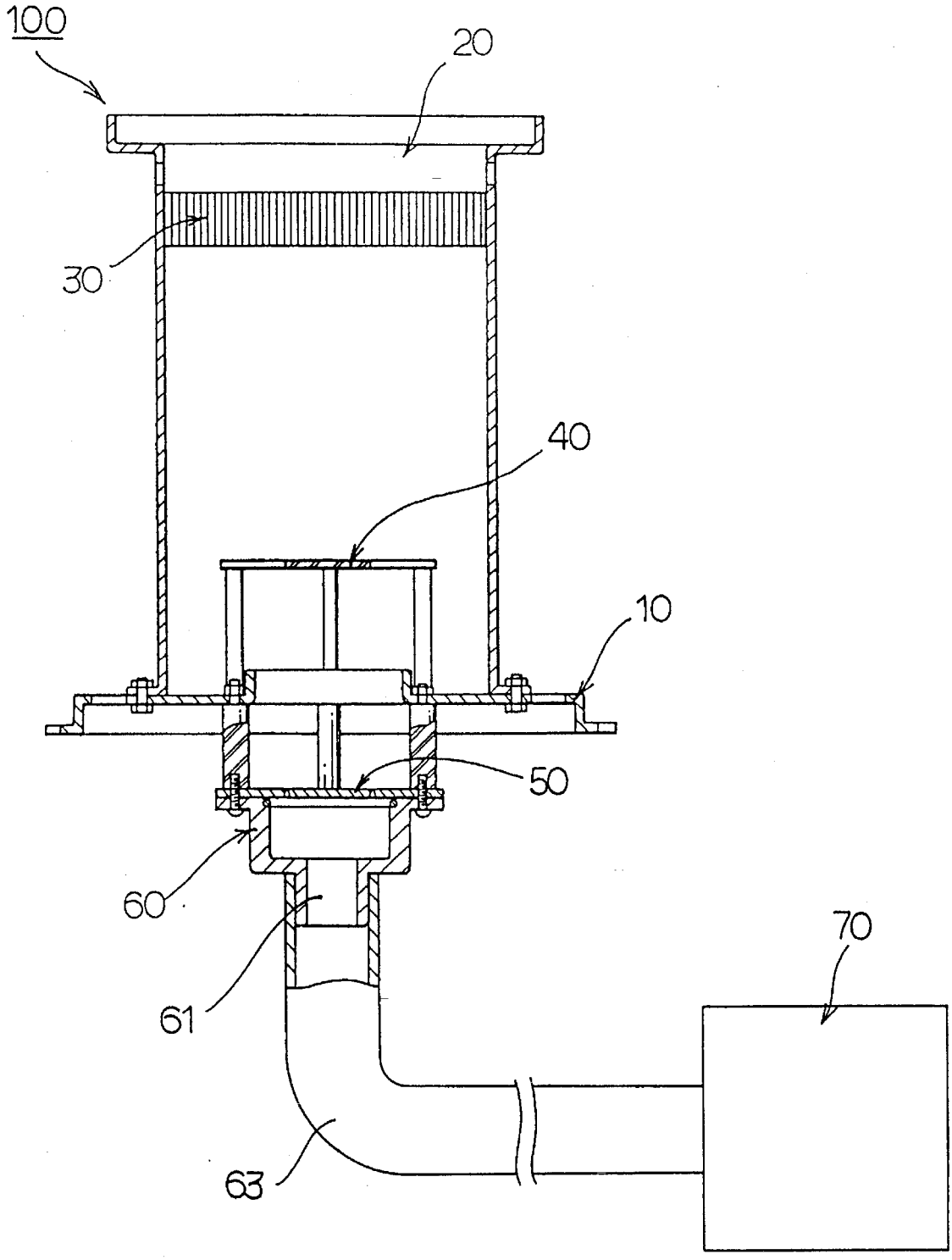
FIG. 4 is a cross-sectional view of another embodiment of the present invention.

FIG. 4 shows another embodiment of the present invention, which is suitable in a case in which burner 100 and gas valve 70 are spaced. In this embodiment, gas intake 61 of gas chamber 60 and gas valve 70 are connected with a gas pipe 63 of a predetermined length. It does not matter to use a mechanical gas valve as well as an electronic valve.

Figure 5A:
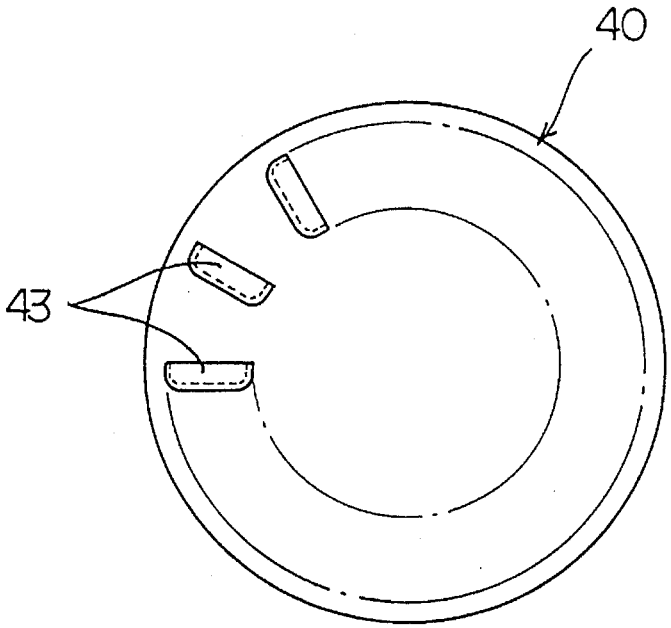
FIG. 5A is a plan view of another embodiment of the mixing plate, a main component, of the present invention.
Figure 5B:
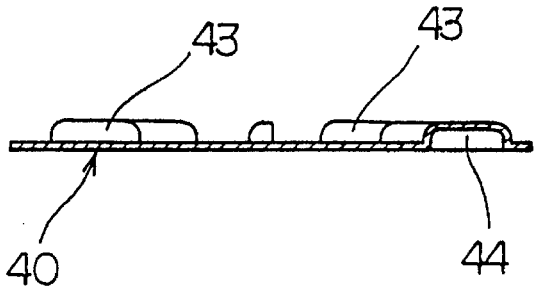
FIG. 5B is a cross-sectional view of the mixing plate of FIG. 5A.
Figure 5C:
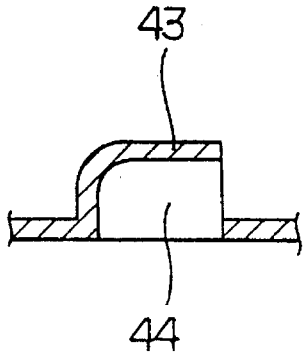
FIG. 5C is an extracted enlarged cross-sectional view of the mixing plate of FIG. 5A.

Referring to FIGS. 5A, 5B and 5C, a plurality of air suction holes 43 are radially disposed on the same circumference of the mixing plate by predetermined intervals. A guide 44 for rotating the flow of air passing through the air suction holes in a whirl form is bent upward above air suction holes 43.

The operation 0f the burner of the present invention will be described below.

As gas valve 70 is turned on for the purpose of operating burner 100, plunger 72 is lowered and opening/closing hole 71 stopping up gas intake hole 61 of gas chamber 60 is also lowered to open the lower end of gas intake hole 61.

When gas intake hole 61 of gas chamber 60 is opened, the gas supplied from gas supply hole 75 comes into gas chamber 60. The gas coming into gas chamber 60 is injected into intake hole 11 of mixing liner support 10 through a plurality of injection holes 52 formed 52 nozzle plate 50.

Here, injection holes 52 formed on nozzle plate 50 are narrower in the upper portion and wider in the lower portion so as to inject gas at a high pressure.

Due to the kinetic energy generated during the process in which gas is injected at a high pressure and enters intake hole 11 of mixing liner support 10 the gas comes into intake hole 11 along with the first air.

The gas and first air entering intake hole 11 of mixing liner support 10 collide against mixing plate 40 of mixing liner 20 so as to be dispersed radially.

Here, a plurality of cut portions 42 are radially formed on mixing plate 40 so that the first air and gas are mixed well, dispersed radially, and raised toward matrix 30.

In the second embodiment of FIG. 5A, as the first air and gas come through the lower end of air suction holes 43 and are raised to their upper end, the first air and gas are rotated in a whirl form by guide 44 and raised to be uniformly dispersed throughout matrix 30.

As the first air and gas are mixed, dispersed and raised above mixing plate 40, they are ejected through flame holes 31 of matrix 30 installed in mixing liner 20.

For combustion, the mixed gas ejected above matrix 30 is ignited by the ignition plug (not shown) installed on ignition plug installation hole 21.

As described above, in the burner of the present invention, gas and the first air are mixed while being raised at a fast speed, and this mixed gas is burned on the surface of the matrix, thereby increasing combustion efficiency, yielding good combustion stability, and minimizing the production of harmful gas.

Further, since injection is directly performed from the injection holes without additional nozzle on nozzle plate 50, unlike the conventional device, the construction of a burner is simplified and miniaturized. This also reduces its production cost.

What is claimed is:

1. A burner for a burning apparatus comprising:

a mixing liner support formed with an intake hole for receiving gas ejected from a nozzle and first air at the center;

a mixing liner, for mixing supplied gas and first air, which is installed above said mixing liner support, and on either upper sidewall of which an ignition plug installation hole and flame sensor installation hole are formed, respectively;

a matrix inserted into the inner upper portion of said mixing liner and having numerous flame holes in a gauze form;

a mixing plate installed above said intake hole of said mixing liner support and spaced apart upward from said mixing liner support with a plurality of spacers, and for radially dispersing gas and the first air;

a nozzle plate installed under said mixing plate and spaced downward from said mixing plate with said spacers, and having a plurality of injection holes disposed at predetermined intervals on the same circumference;

a gas chamber installed under said nozzle plate and formed with a gas intake in the lower portion; and a gas valve installed under said gas chamber and for opening/closing said gas intake of said gas chamber.

2. A burner for a burning apparatus as claimed in claim 1, wherein in order to effectively disperse gas and first air, a plurality of cut portions are radially formed on said mixing plate by predetermined intervals.

3. A burner for a burning apparatus as claimed in claim 1, wherein a plurality of air suction holes are radially disposed on the same circumference of said mixing plate by predetermined intervals, and a guide for rotating the flow of air passing through said air suction holes in a whirl form is bent upward above said air suction holes.

4. A burner for a burning apparatus as claimed in claim 1, wherein a plurality of injection holes are disposed on the same circumference of said nozzle plate at predetermined intervals, said injection holes being narrower in the upper portion and wider in the lower portion so as to raise a gas ejection pressure.

5. A burner for a burning apparatus as claimed in claim 1, wherein said gas valve comprises a plunger for opening/closing said gas intake, a solenoid for linearly moving said plunger, and a spring for applying a upward force to said plunger.

* * * * *